US012601524B1

(12) United States Patent
Chinnasamy et al.

(10) Patent No.: US 12,601,524 B1
(45) Date of Patent: Apr. 14, 2026

(54) CONDENSATE TRAP SYSTEM WITH BLOCKAGE DETECTION AND HEATING SYSTEM FREEZE-PROTECTION CONTROL

(71) Applicant: Intellihot, Inc., Galesburg, IL (US)

(72) Inventors: Sivakumar Chinnasamy, Mundelein, IL (US); Miguel Gonzales, McHenry, IL (US); Sridhar Deivasigamani, Mundelein, IL (US); Sivaprasad Akasam, Round Rock, TX (US)

(73) Assignee: Intellihot, Inc., Galesburg, IL (US)

( * ) Notice: Subject to any disclaimer, the term of this patent is extended or adjusted under 35 U.S.C. 154(b) by 0 days.

(21) Appl. No.: 19/358,285

(22) Filed: Oct. 14, 2025

(51) Int. Cl.
*F24H 9/16* (2022.01)
*F24H 8/00* (2022.01)

(52) U.S. Cl.
CPC ..... *F24H 9/16* (2013.01); *F24H 8/006* (2013.01)

(58) Field of Classification Search
CPC .... F24H 8/006; F24H 9/16; E03C 1/29; F24F 13/22; F24F 13/222
See application file for complete search history.

(56) References Cited

U.S. PATENT DOCUMENTS 5,069,042 A * 12/1991 Stuchlik, III ..... F25D 21/14 62/289

FOREIGN PATENT DOCUMENTS

CN 107213758 A * 9/2017 ..... B01D 5/00
KR 20090003292 U * 4/2009 ..... C02F 1/66
WO WO-2004104307 A1 * 12/2004 ..... E03C 1/284

* cited by examiner

*Primary Examiner* — Eric S Ruppert
(74) *Attorney, Agent, or Firm* — Jong Patent Firm; Cheng Ning Jong; Tracy P. Jong

(57) ABSTRACT

Disclosed is a condensate trap system for condensing appliances. The trap includes a cap, a dip tube extending through the cap from a top end to a bottom end, and a canister that houses a cup and has a bottom drain port. An opening along the dip tube proximate the top end is in gas communication with a pressure sensor. The canister's top end is removably coupled to the cap, with the dip tube's bottom end disposed within the cup interior. During normal operation, condensate received at the cap fills the cup, overflows, and exits the canister via the drain port while the opening remains unsubmerged. If the drain port or downstream plumbing is obstructed, liquid rises to submerge the opening, interrupting gas communication and generating a sensor signal indicative of a blocked condensate path.

6 Claims, 10 Drawing Sheets

CONDENSATE TRAP SYSTEM WITH BLOCKAGE DETECTION AND HEATING SYSTEM FREEZE-PROTECTION CONTROL

BACKGROUND OF THE INVENTION

1. The Field of the Invention

The present invention relates to condensate management and freeze protection in high-efficiency heating appliances. More specifically, the present invention is directed to a removable, high-capacity condensate trap with pressure-based blockage detection and to a temperature-sensor-driven control scheme that prevents freezing within an appliance housing.

2. Background Art

Tankless water heaters, high-efficiency boilers, and other condensing appliances generate acidic condensate as a byproduct of the combustion process. This condensate must be properly drained to prevent damage to internal components and the surrounding structure. A condensate trap is typically employed to allow for proper drainage while preventing the backflow of combustion gases to ensure safe and efficient operation.

Conventional condensate traps, however, present several drawbacks. In many systems, the trap is integrated or semi-permanently connected within the appliance housing or drain line, making it difficult to access, remove, or service. Over time, condensate traps can accumulate debris, e.g., scale, corrosion particles, or biological growth, leading to blockages or restricted flow. This can result in system shutdowns, error codes, or overflow conditions, particularly in unattended or low-maintenance installations.

Routine cleaning of the condensate trap is therefore essential to maintain the performance and longevity of the appliance. However, existing trap designs often require disassembly with tools, detachment of rigid plumbing, or navigation through cramped spaces, posing a challenge to both homeowners and service technicians.

Furthermore, many conventional traps have limited internal capacity, which increases the frequency of required maintenance. A trap with an enlarged internal volume can provide increased debris-holding capacity, allowing for the accumulation of sediment or particulates over an extended period before cleaning is necessary. This feature is especially beneficial in environments prone to high particulate loads or in systems that are difficult to access frequently.

Accordingly, there is a need for a condensate trap that not only allows for easy, tool-free removal and convenient access for cleaning but also offers increased capacity to retain debris, thereby reducing the required cleaning frequency. The present invention addresses these needs by providing a condensate trap assembly configured for quick maintenance and extended operational intervals between servicing.

Another important operational concern in condensing appliances is the risk of freezing, particularly in water heaters that draw in cold ambient air for combustion. When outdoor temperatures drop, incoming combustion air can significantly lower the internal temperature of the water heater housing, especially during standby periods when the burner is inactive. In such conditions, residual water in internal piping or the condensate system may freeze, leading to cracked components, water leaks, and expensive damage.

To address this, it is desirable to incorporate a temperature sensor within the water heater housing to monitor internal air temperature. When the temperature approaches a predefined threshold indicating potential freezing conditions, the system can issue a warning notification or trigger protective measures. This feature is especially critical for units installed in unconditioned spaces such as garages, attics, or outdoor enclosures, where exposure to low ambient temperatures is more likely.

Accordingly, there is a need for a condensate management system that includes both a removable, high-capacity condensate trap that simplifies maintenance and reduces service frequency, and an integrated temperature sensor that detects potential freeze conditions and enables timely alerts or protective actions. The present invention addresses both of these needs in a unified system suitable for use in modern high-efficiency water heaters.

SUMMARY OF THE INVENTION

In accordance with the present invention, there is provided a condensate trap system including:

a condensate trap including:

(a) a cap;

(b) a dip tube extending through the cap from a top end to a bottom end, the dip tube having an opening along its length proximate the top end of the cap, the dip tube being configured to receive condensate from a condensate-generating appliance at the top end of the cap, the opening being in gas communication with a pressure sensor; and (c) a canister having a top end and a bottom end, a cup supported within the canister, and a drain port at the bottom end of the canister, the top end of the canister being removably coupled to the cap and the bottom end of the dip tube being disposed within an interior cavity of the cup, wherein, in an unblocked condition in which neither the drain port nor a downstream portion thereof is obstructed, condensate received at the top end of the cap flows to fill and overflow the cup and exits the canister via the drain port; and wherein, in a blocked condition in which at least one of the drain port and a downstream portion thereof is obstructed, condensate fails to drain and rises to submerge the opening in the dip tube, thereby interrupting gas communication to the pressure sensor and causing the pressure sensor to register a pressure indicative of blockage of condensate drainage through the trap.

In one embodiment, the top end of the canister is threadably coupled to the cap. In one embodiment, the top end of the dip tube is threadably coupled to a condensate drain tube. In one embodiment, the condensate trap system further includes a controller, wherein the pressure sensor is operably connected to the controller and upon detecting the pressure indicative of blockage of condensate drainage through the trap, the controller is configured to provide a response selected from the group consisting of issuing a local visual and/or audible alarm via a local output device, transmitting a remote alert through a communication module to a remote output device, logging a diagnostic fault code in the controller, inhibiting modulation or shutting down at least one heating unit to place the appliance in a safe state, and any combinations thereof. In one embodiment, the cap includes a pressure sensing port in fluid communication with the opening via a pressure sensing line. In one embodiment, the cup stand includes a plurality of stands defining flow passages to the drain port when the cup overflows. In one embodiment, the cap further includes a threaded male fitting configured to mate with a condensate drain tube. In one embodiment, the canister defines an internal volume of at least about 400 mL to provide debris-holding capacity before overflow to the drain port.

In accordance with the present invention, there is further provided a freeze-protection control system for an appliance having a plurality of heating units, including:

(a) at least one temperature sensor disposed to sense an internal air temperature of an appliance housing; and (b) a controller operatively coupled to the temperature sensor and to the heating units, the controller being configured to:

(i) periodically obtain a temperature value T from the temperature sensor;

(ii) compare T to a low-temperature threshold $T_l$;

(iii) when $T \leq T_l$, enter a freeze-protect state in which the controller overrides demand control and commands each of the heating units on at a predetermined non-modulated output sufficient to circulate heat through fluid lines; and (iv) when $T \geq T_l + \Delta T$, where $\Delta T$ is a hysteresis offset, revert to normal control;

wherein the normal control includes variable-output control of a heating unit by varying at least one of firing rate, stage selection, duty cycle, fuel-valve position, blower speed, pump speed, and equivalent actuation to match thermal demand.

In one embodiment, the low-temperature threshold $T_l$ is configurable. In one embodiment, the freeze-protection control system further includes an alert interface through which the controller issues a local and/or remote notification upon entry into the freeze-protect state. In one embodiment, the at least one temperature sensor is a plurality of temperature sensors and the controller is configured to represent temperature registered by the at least one temperature sensor using one of a minimum, maximum, and average of their readings. In one embodiment, the normal control includes demand-based modulation of thermal output. In one embodiment, the freeze-protection control system further includes at least one of (a) an internal recirculation loop having a corresponding pump, and (b) an external recirculation loop having an associated pump, wherein, during the freeze-protect state, the controller is configured to selectively energize the pump of any provided recirculation loop.

In accordance with the present invention, there is further provided a method of protecting an appliance against freezing, the method including:

(a) obtaining, by a controller, a temperature T from at least one temperature sensor within an appliance housing; and (b) comparing T to a low-temperature threshold $T_l$, wherein when $T \leq T_l$, entering a freeze-protect state by commanding a plurality of heating units on at a predetermined non-modulated output and when $T \geq T_l + \Delta T$, reverting to normal, modulated demand control, wherein the normal, modulated demand control is a variable-output control including at least one of staged operation, duty-cycle control, proportional firing, variable valve position, variable blower speed, and variable pump speed.

In one embodiment, the method further includes issuing an alert upon entering the freeze-protect state. In one embodiment, the method further includes, in the freeze-protect state, energizing at least one circulation pump to drive flow through at least one of an internal recirculation loop and an external recirculation loop. In one embodiment, the method further includes determining a rate of change of temperature and preemptively entering the freeze-protect state when a magnitude of temperature decrease exceeds a threshold. In one embodiment, the normal, modulated control includes demand-based modulation of thermal output.

It is an object of the present invention to provide a removable condensate trap management system for condensing appliances.

It is a further object to permit tool-free removal and reinstallation of the trap for routine cleaning without detaching rigid plumbing or navigating cramped spaces.

It is a further object to provide an enlarged internal volume within the trap to increase debris-holding capacity and extend service intervals.

It is a further object to maintain a reliable gas seal to prevent backflow of combustion gases while allowing proper condensate drainage.

It is a further object to incorporate an internal temperature sensor to monitor housing air temperature and detect potential freeze conditions, and to provide control logic that, upon approaching threshold temperatures, issues alerts and/or triggers protective measures.

It is a further object to reduce shutdowns, and error codes associated with trap blockage or restricted flow.

It is a further object to furnish a retrofit-friendly assembly adaptable to appliances with integrated or semi-permanent factory traps.

It is a further object to improve overall appliance reliability and longevity by facilitating regular maintenance, reducing service frequency, and minimizing damage from debris accumulation or freezing.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

Figure 1:
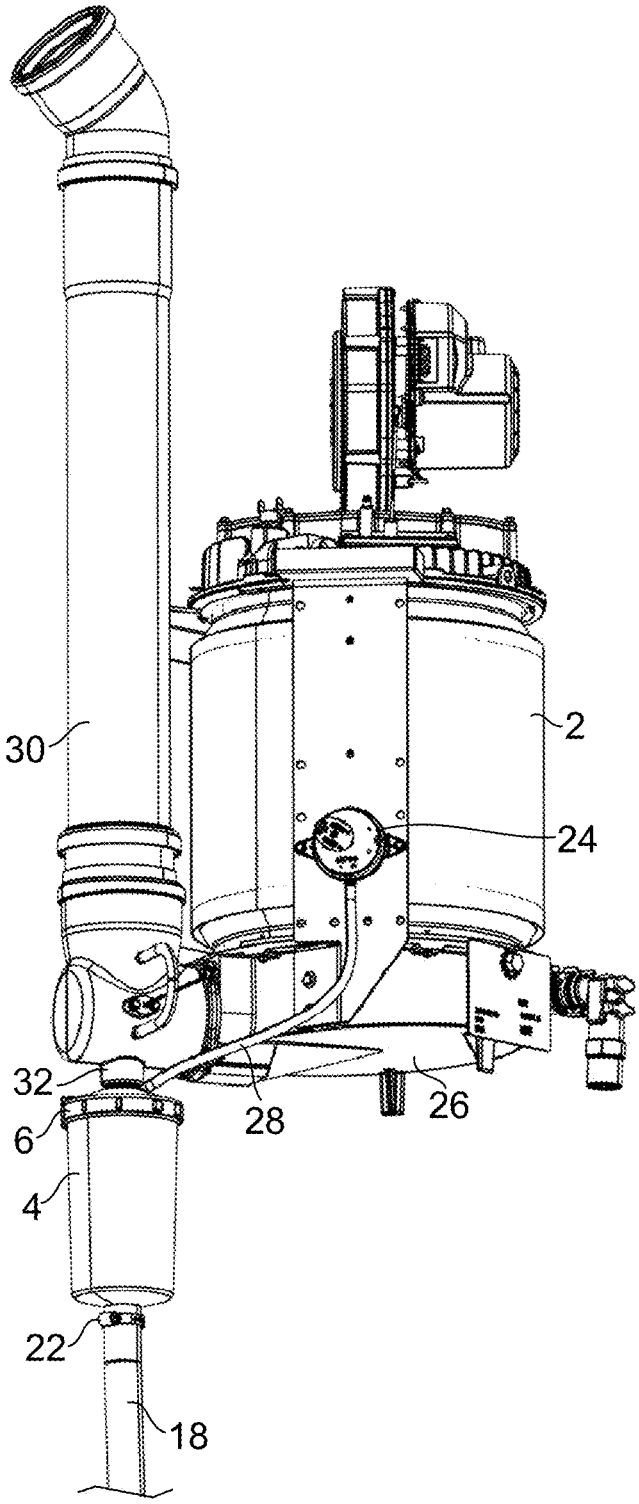
FIG. 1 is a bottom perspective view of a condensing heating system showing a heat exchanger coupled to a condensate trap system and a flue-gas exhaust.

2—heat exchanger
4—condensate trap system
6—cap, e.g., threaded cap
8—canister
10—cup
12—cup stand
14—top opening of canister
16—hose connection port
18—hose
20—condensate
22—clamp
24—pressure sensor
26—condensing flue-gas collector plenum having condensate drain
28—pressure sensing line fluidly coupling the condensate trap system to pressure sensor to convey condensate trap system pressure to the pressure sensor
30—flue gas exhaust
32—condensate drain tube fluidly coupled to the flue-gas exhaust and configured to convey condensate downwardly to condensate trap system
34—threaded male fitting configured to be mated with condensate drain tube
36—threads
38—condensate drain port
40—pressure sensing port
42—dip tube
44—blockage, e.g., debris and particles
46—heating system or heating unit housing or cabinet
48—temperature sensor
50—controller
52—local output device
54—removable connection, e.g., threaded connection
56—communication module
58—router
60—internet
62—remote output device
64—opening
66—door
68—louvers
70—heat unit
72—exhaust of hose
74—drain grate
76—drain
78—cold air flow
80—step of obtaining temperature from temperature sensor disposed within housing of appliance
82—step of comparing temperature to a low-temperature threshold $T_l$
84—step of reverting to normal control
86—step of turning on all heat units

PARTICULAR ADVANTAGES OF THE INVENTION

The disclosed condensate trap system affords rapid, tool-free serviceability. A threadable cap allows immediate access to a removable cup housed within a canister, so accumulated debris can be emptied and the interior wiped or rinsed without detaching rigid plumbing or disturbing adjacent components. This improves technician efficiency and enables appliance owners and service personnel to perform routine maintenance, reducing unscheduled service calls and downtime. Further, the trap provides extended debris-holding capacity. An enlarged internal volume within the cup/canister assembly captures scale, corrosion particles, and biological growth over longer intervals before cleaning is required. By delaying blockage onset, the design reduces nuisance shutdowns, error codes, and overflow events in unattended or hard-to-reach installations.

The condensate trap design incorporates intrinsic blockage detection using a passive, fluidic "switch." A dip tube extends through the cap with a gas opening proximate the cap's top and in gas communication with a pressure sensor. Under normal drainage, the opening remains unsubmerged, preserving a clear gas path to the sensor. If the drain port or downstream plumbing becomes obstructed, rising condensate submerges the opening, interrupting gas communication and producing a distinct sensor reading indicative of blockage. This arrangement requires no floats, moving parts, or wetted electrical elements, enhancing reliability and simplifying manufacturing. The condensate trap system provides condensate management that enhances appliance reliability and longevity by preventing damage from condensate backup in the condensing flue-gas collector plenum due to debris accumulation or freezing.

Further disclosed is a freeze-risk monitoring and protective control system. A temperature sensor disposed within the appliance housing of a condensing heat exchanger monitors internal air temperature to detect approaching freeze conditions and, via control logic, can issue alerts and/or initiate a protective action. In the absence of a water-use demand, the controller automatically schedules the protective action to raise the cabinet temperature by turning on the heating units and circulating water through at least one of an internal recirculation loop and an external recirculation loop, thereby restoring a safe appliance thermal margin.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

As used herein, "heating unit" refers to any apparatus configured to raise the temperature of a fluid, including, without limitation, a combustion burner/heat-exchanger assembly, an electric resistance or induction heater, or a heat pump. Where the heating unit is an electric resistance or induction heater, or a heat pump, no burner or combustion process is involved. Accordingly, such implementations do not generate condensate.

Figure 2:
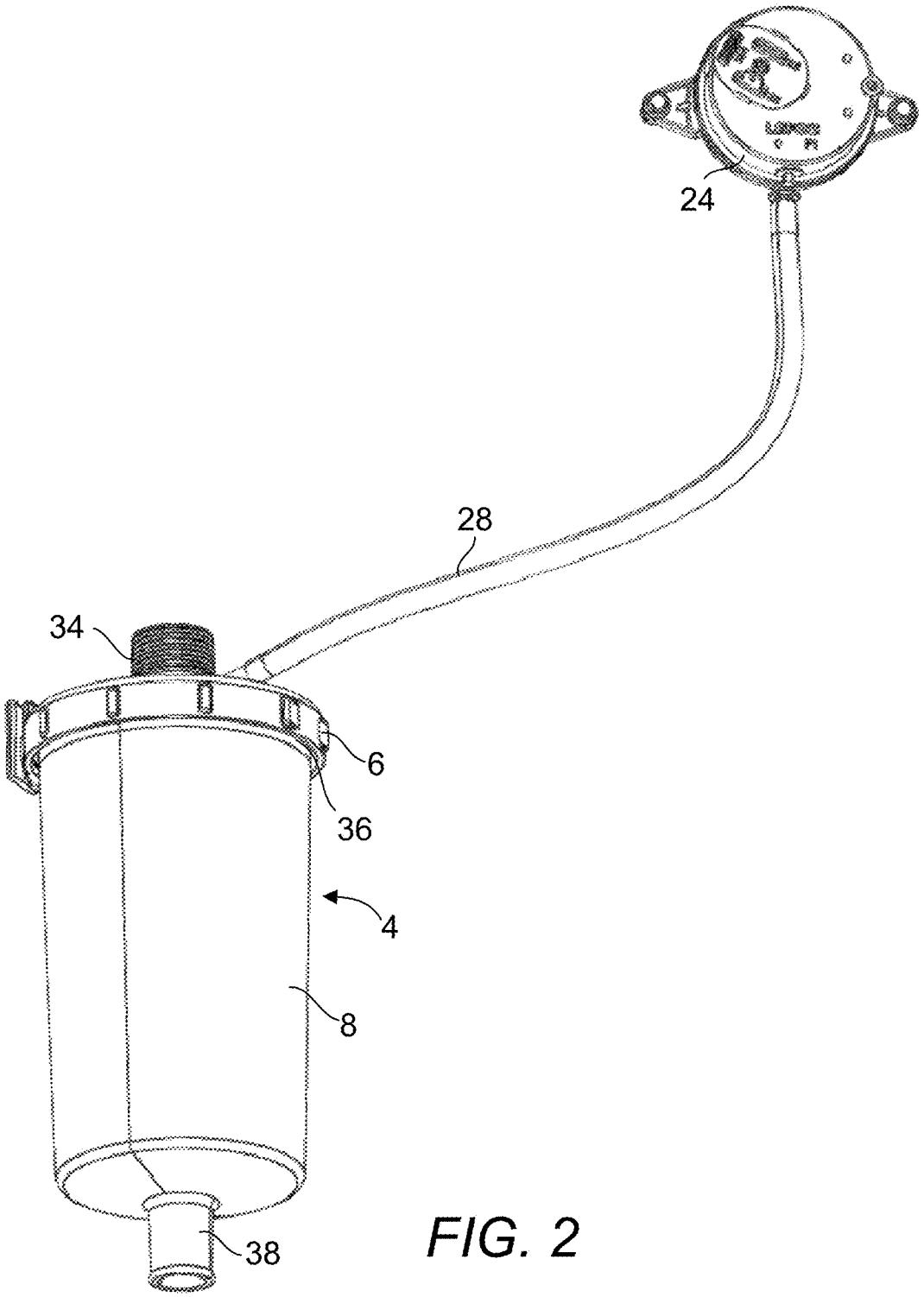
FIG. 2 is a bottom perspective view of a condensate trap system configured to be in gas communication with a pressure sensor.
Figure 3:
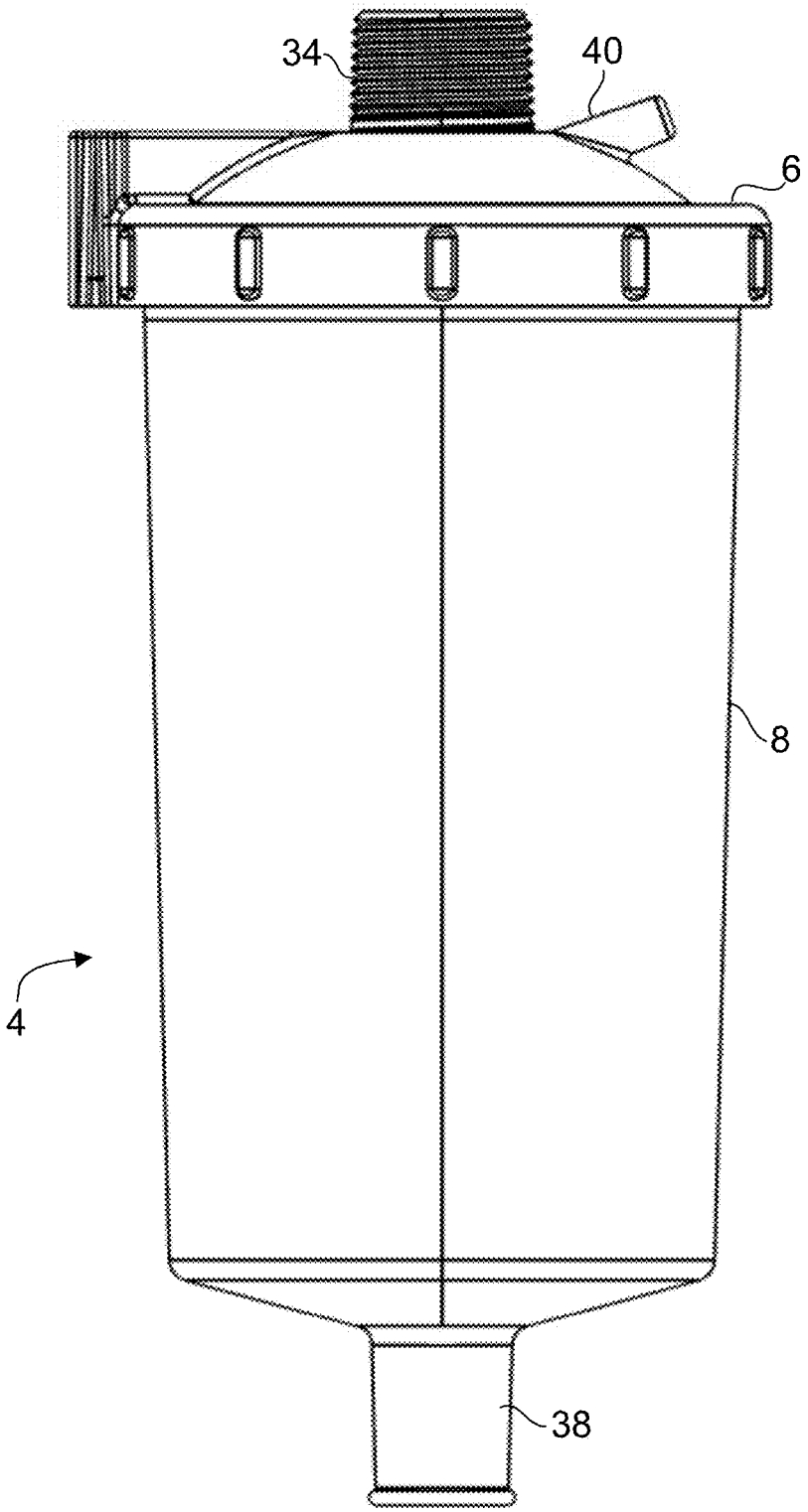
FIG. 3 is a side elevational view of the condensate trap system of FIG. 2.

FIG. 1 is a bottom perspective view of a condensing heating system showing a heat exchanger coupled to a condensate trap system 4 and a flue-gas exhaust 30. A condensing flue-gas collector plenum 26 having a condensate drain is also shown. FIG. 2 is a bottom perspective view of a condensate trap system configured to be in gas communication with a pressure sensor 24. FIG. 3 is a side elevational view of the condensate trap system of FIG. 2. The heating system 2, e.g., a water heating system, employs combustion of a hydrocarbon fuel to produce heat. In high-efficiency, e.g., >90% efficient condensing combustion systems, water vapor in the flue gas is intentionally condensed to reclaim latent heat of vaporization, thereby increasing thermal efficiency. The resulting, typically acidic, condensate is collected, routed through a neutralizer, and discharged to a drain, e.g., through a drain tube. In a condensate drain tube 32 without a trap, it is possible for some flue gas to escape via the drain tube 32, although most of the flue gas would exit through the flue gas exhaust 30 that is directed upwardly due to its temperature that is higher than the ambient air and therefore tends to rise through the exhaust 30 and exits to the atmosphere. In the absence of a trap on the condensate drain tube, a portion of flue gas may escape through the drain. Although a P-trap or S-trap can be used to prevent flue gas from exiting through the drain tube, each is a rigid component that is not intended to be dismantled for cleaning when debris and particles accumulate within the trap. Therefore, if a blockage occurs, a P-trap or S-trap must be replaced. Accordingly, the present condensate trap system provides a serviceable mechanism that receives condensate at the condensate drain tube 32 and establishes a liquid seal to prevent flue-gas escape through the drain path. Unlike rigid P- or S-traps, the assembly is configured for tool-free disassembly so the trap can be opened and cleaned to remove debris and particles that might otherwise obstruct or back up condensate flow.

In one embodiment, a present condensate trap system 2 receives condensate 20 from a condensing heat exchanger 2 and directs it to a condensate trap 4 that includes a cap 6, e.g., a threaded cap, a dip tube 42 extending through the cap 6 from a top end to a bottom end, and a canister 8 that houses a cup 10 supported on a plurality of cup stands 12. The cup stands 12 allow the condensate that overflowed the cup 10 to exit the canister 8. The canister 8 defines a top opening 14 that is removably coupled to the cap 6 via a removable connection 54, e.g., by threads 36, and includes a drain port at its bottom end. An opening 64 along the dip tube 42 near the top of the cap 6 is placed in gas communication with a pressure sensor 24 via a pressure sensing line 28 connected at a pressure sensing port 40. The bottom end of the dip tube 42 projects into an interior cavity of the cup 10 within the canister 8. In one embodiment, the canister defines an internal volume of at least about 400 mL, providing sufficient debris-holding capacity before any overflow to the drain port. It was found that this capacity enables the appliance to operate between scheduled maintenance intervals without condensate blockage issues.

Figure 4:
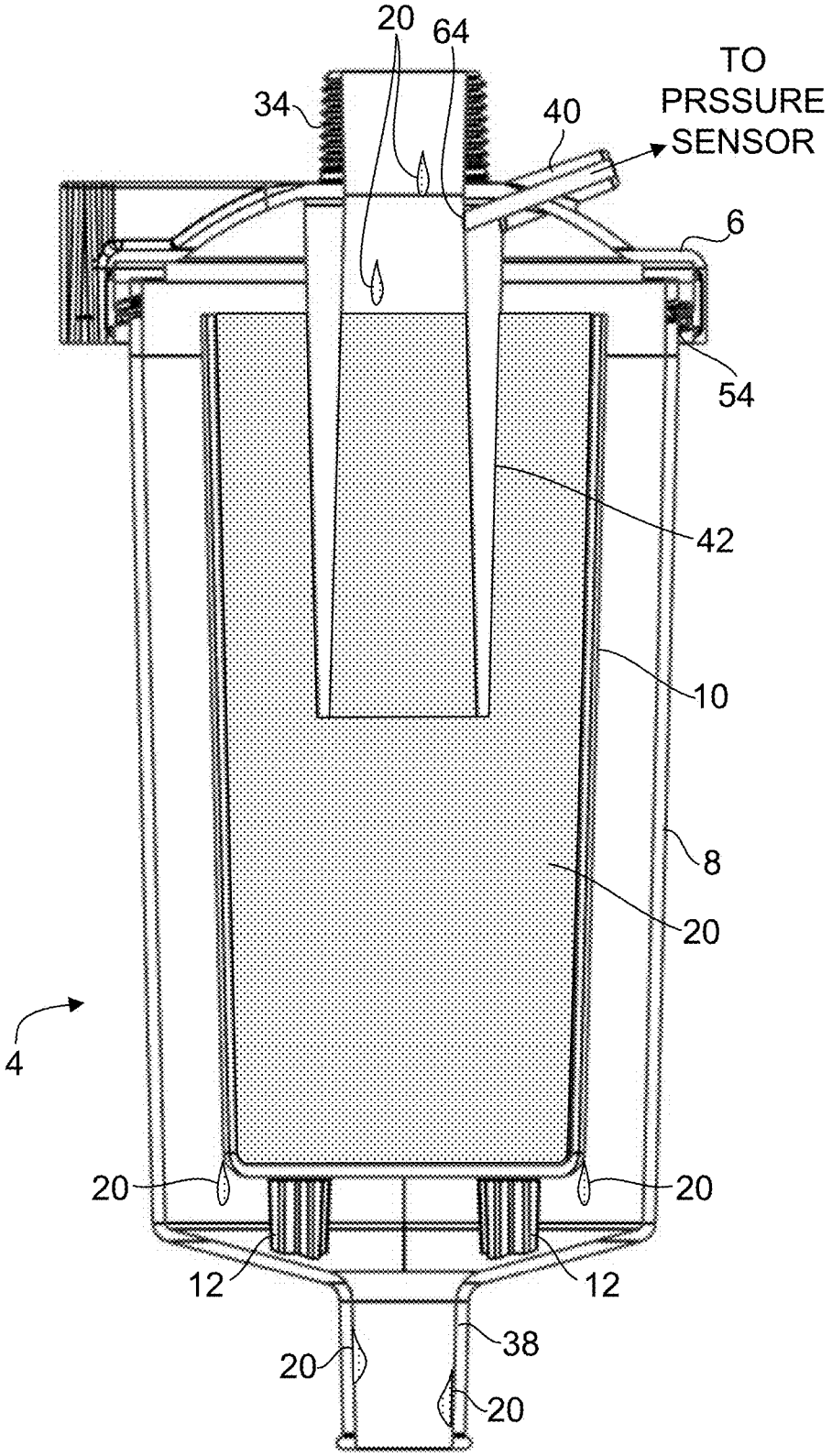
FIG. 4 is a side cross-sectional view of the condensate trap system illustrating normal operation.
Figure 5:
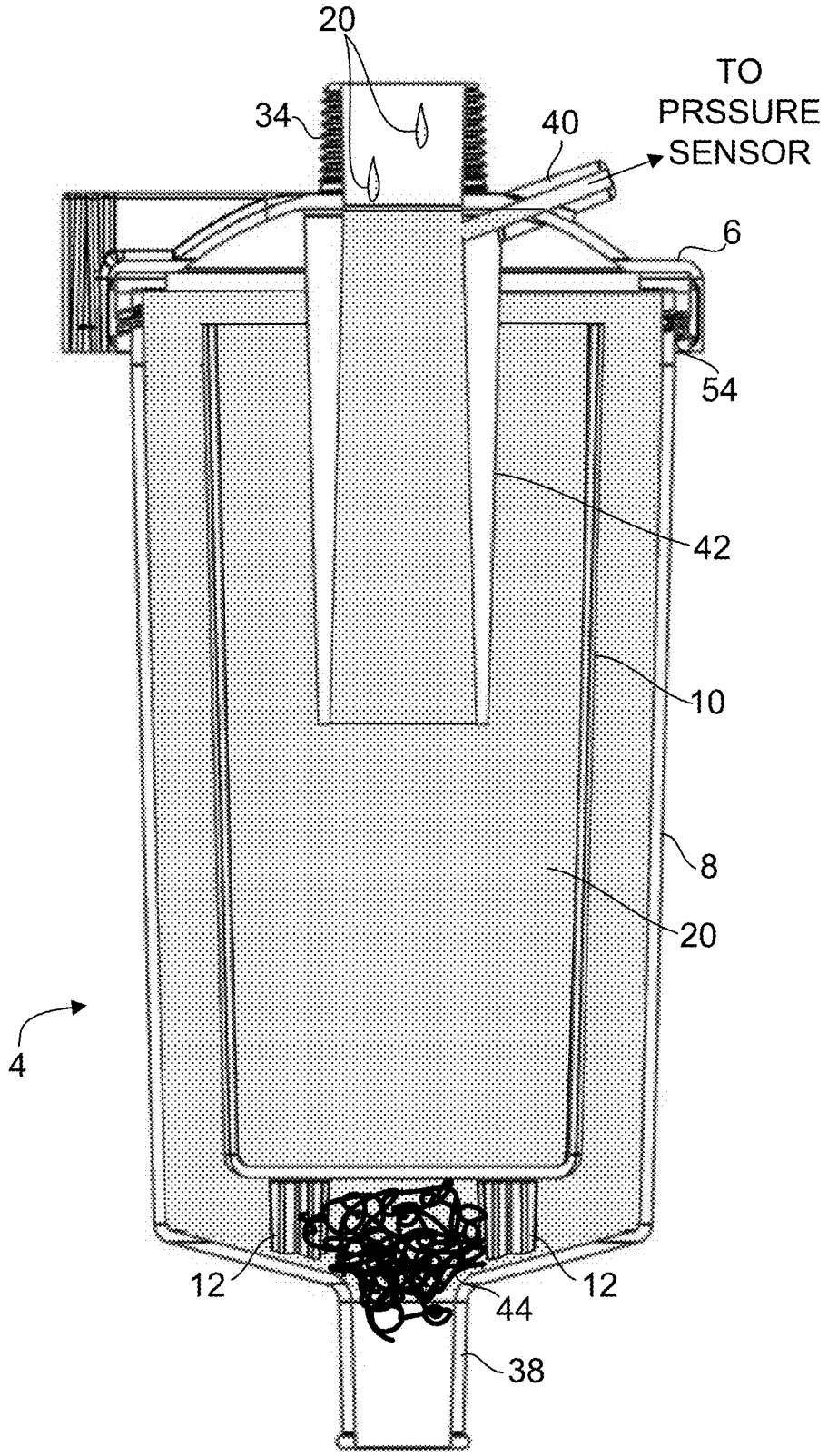
FIG. 5 is a side cross-sectional view of the condensate trap system illustrating a first inadvertent blockage condition.
Figure 6:
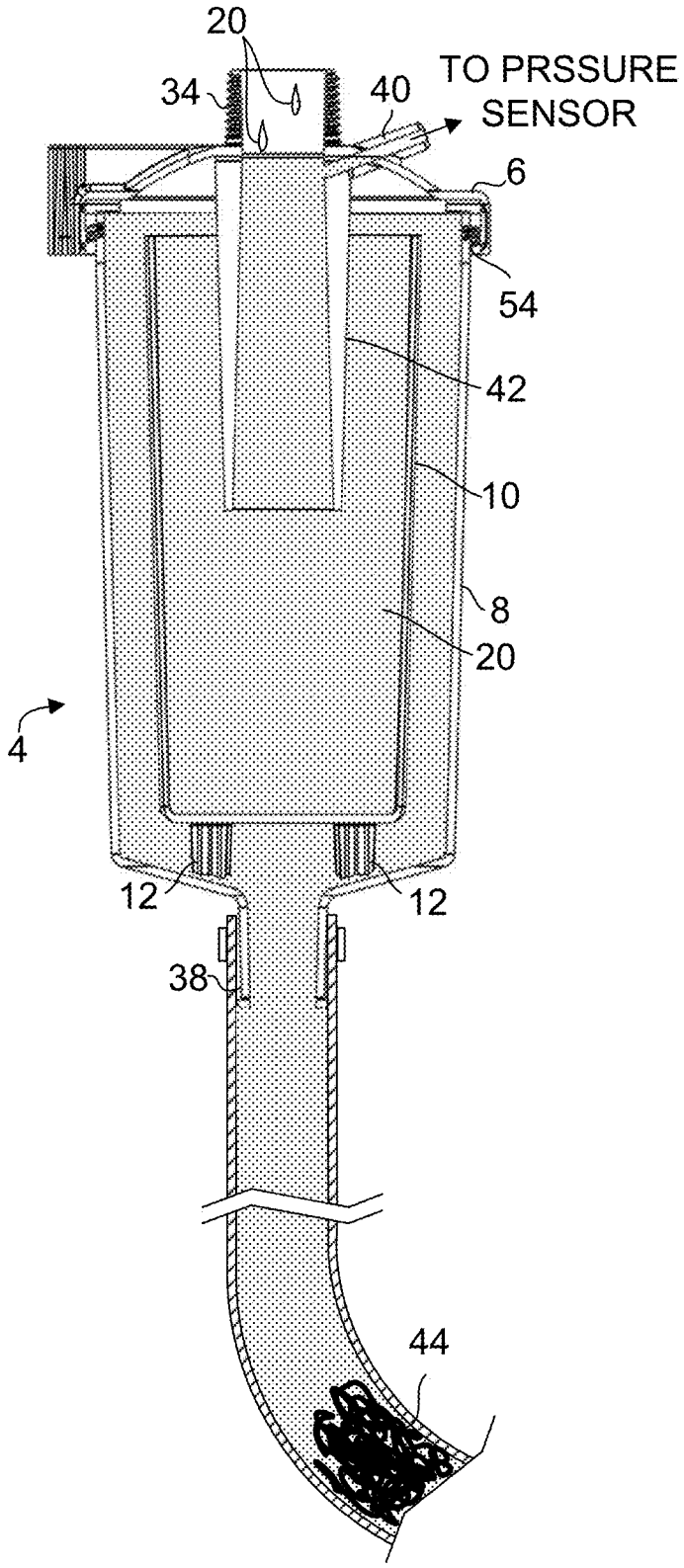
FIG. 6 is a side cross-sectional view of the condensate trap system illustrating a second inadvertent blockage condition.

FIG. 4 is a side cross-sectional view of the condensate trap system 4 illustrating normal operation. FIG. 5 is a side cross-sectional view of the condensate trap system illustrating a first inadvertent blockage condition, in which a blockage 44 occurs at the drain port 38 and prevents gravity-assisted condensate flow. FIG. 6 is a side cross-sectional view of the condensate trap illustrating a second inadvertent blockage condition, in which the blockage 44 is located downstream of the drain port 38, e.g., within an external condensate drain line such as the hose 18 coupled to the drain port 38 at a hose connection port 16 and secured by a clamp 22. During normal, unblocked operation, i.e., when the drain port 38 and downstream plumbing are unobstructed, condensate 20 admitted at the top of the cap 6 flows down the dip tube 42, fills the cup 10, overflows into the surrounding volume of the canister 8, and exits through the drain port 38, while the dip-tube opening 64 remains unsubmerged to preserve gas communication through the pressure sensing line 28 to a pressure sensor 24. Flue gas admitted at the threaded male fitting 34 is prevented from escaping via the condensate trap system 4 once the bottom end of the dip tube 42 becomes submerged. In a blocked condition, i.e., when the drain port 38 and/or a downstream portion of the external condensate drain line is obstructed, condensate 20 fails to evacuate, the condensate level rises within the canister 8 and into the threaded condensate inlet at the fitting 34, and the dip-tube opening 64 becomes submerged. Submergence elevates pressure in the pressure sensing line 28. When this pressure exceeds a predetermined trip value, e.g., the rated setpoint of an air-switch type pressure sensor 24, the air switch trips and the controller 50 generates an alarm on a local output device 52 and/or a remote output device 62 via communication module 56, indicating a blocked condensate path. If left unaddressed, the blockage can cause condensate to back up, ultimately impeding flue-gas flow and degrading heating system performance.

Figure 7:
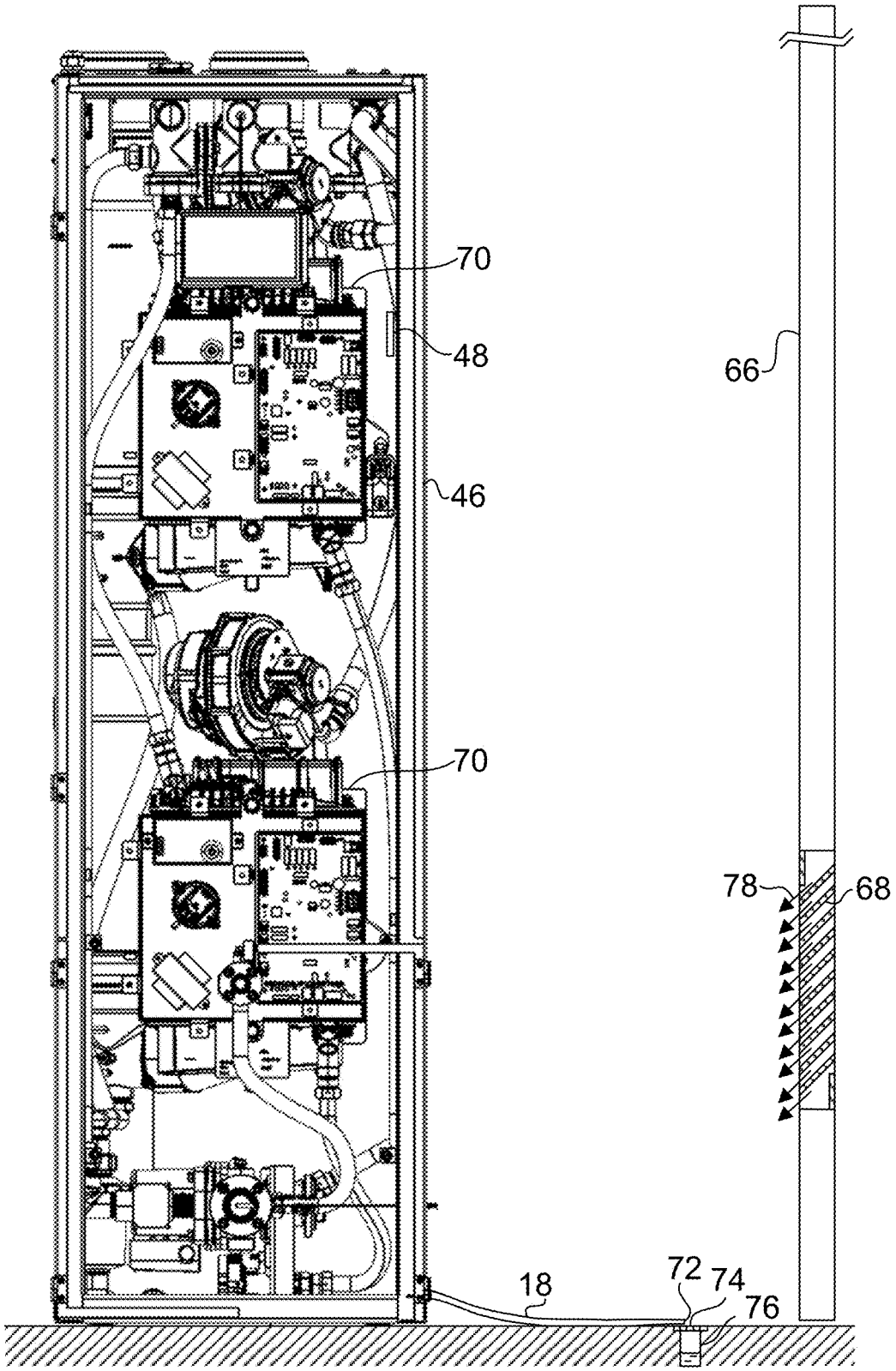
FIG. 7 is a front elevational view of a heating system with the housing or cabinet shown open with its front door removed to reveal internal components.
Figure 8:
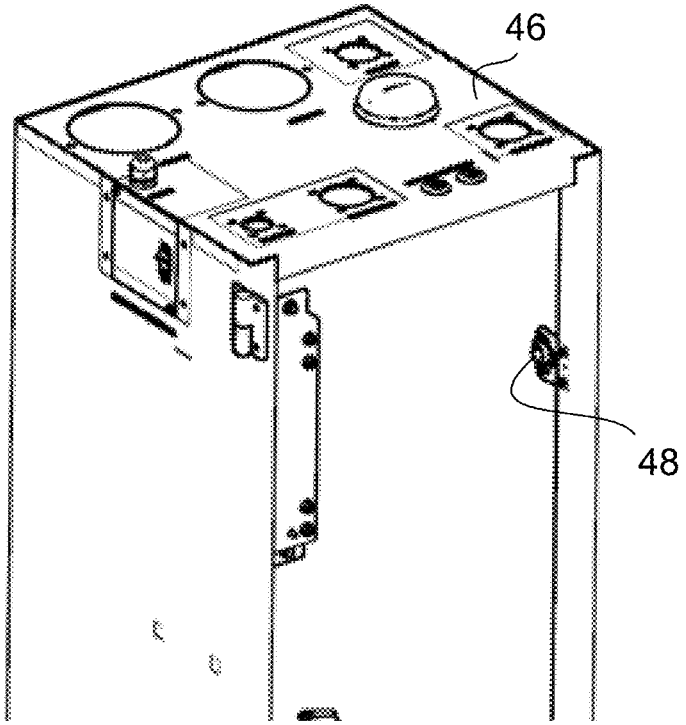
FIG. 8 is a partial perspective view of the appliance housing or cabinet with the front door removed, illustrating an exemplary in-cabinet mounting location for the temperature sensor on a side wall where interior components are omitted for clarity.

FIG. 7 is a front elevational view of a heating system with the housing or cabinet 46 shown open with its front door removed to reveal internal components. FIG. 8 is a partial perspective view of the appliance housing or cabinet 46 with the front door removed, illustrating an exemplary in-cabinet mounting location for the temperature sensor 48 on a side wall. Interior components are omitted for clarity. See FIG. 7 for a corresponding view with internal components shown. A temperature sensor 48 is mounted within the cabinet proximate the heating units 70, to sense cabinet-air temperature for the freeze-risk monitoring and protective control described herein. Also illustrated is an example condensate discharge path wherein a hose 18 runs along the floor to an exhaust 72 that discharges through a drain grate 74 into a drain 76. To depict a typical cold-air exposure scenario, a louvered door 66 having louvers 68 is shown schematically adjacent the appliance, with arrows 78 indicating infiltration of dense, cold air that can settle near floor-level piping. The placement of the temperature sensor 48 inside the cabinet enables detection of low-temperature conditions regardless of condensate status. Other in-cabinet mounting locations may be used, so long as they provide an accurate indication of an impending freeze condition. For example, the sensor should not be placed where internal insulation or other thermal anomalies would materially bias the measured temperature relative to the cabinet air surrounding the heating system. Further, in many installations, modern condensing water-heating systems draw combustion air from outdoors through code openings or ducted intakes.

In cold weather, this air can cold-soak the appliance cabinet, particularly during standby or off-peak periods when some heat exchangers are idle and circulation is minimal, whereas peak-demand operation with continuous flow inherently mitigates freezing. The risk is amplified in unconditioned locations, e.g., garages, attics, crawlspaces, rooftops, outdoor enclosures, and in mechanical rooms with louvered doors or make-up-air grilles that admit dense, cold air which settles around floor-level piping and condensate components, and by long or partially exterior runs of water supply or condensate tubing, neutralizers near cold floors, and intake/exhaust penetrations at outside walls. One example of a heating system exposed to cold air due to installation in an unconditioned room is illustrated in FIG. 7. As local temperatures approach 0 degrees C., residual water in exchangers, manifolds, or condensate circuits can freeze, progressing from partial blockage to full ice plugs and resulting in appliance lockouts, condensate overflow, and cracked components.

To address this risk, one or more temperature sensors mounted within the appliance housing periodically report housing-air temperature to the controller. When the sensed temperature approaches a predefined freeze threshold, the controller overrides demand-based modulation and commands the heating units on at a non-modulated output to drive warm water through internal circuits, elevate housing temperature, and keep condensate drainable. Once the temperature recovers above the threshold, optionally with hysteresis, normal modulated control resumes. This approach prevents freeze-up using resources already present for water heating, without dedicated heaters or continuous parasitic loads, and is readily applicable, with minor adaptations, to other condensing appliances, e.g., boilers, furnaces, packaged systems, that face similar cold-air exposure and standby cold-soak conditions.

Figure 9:
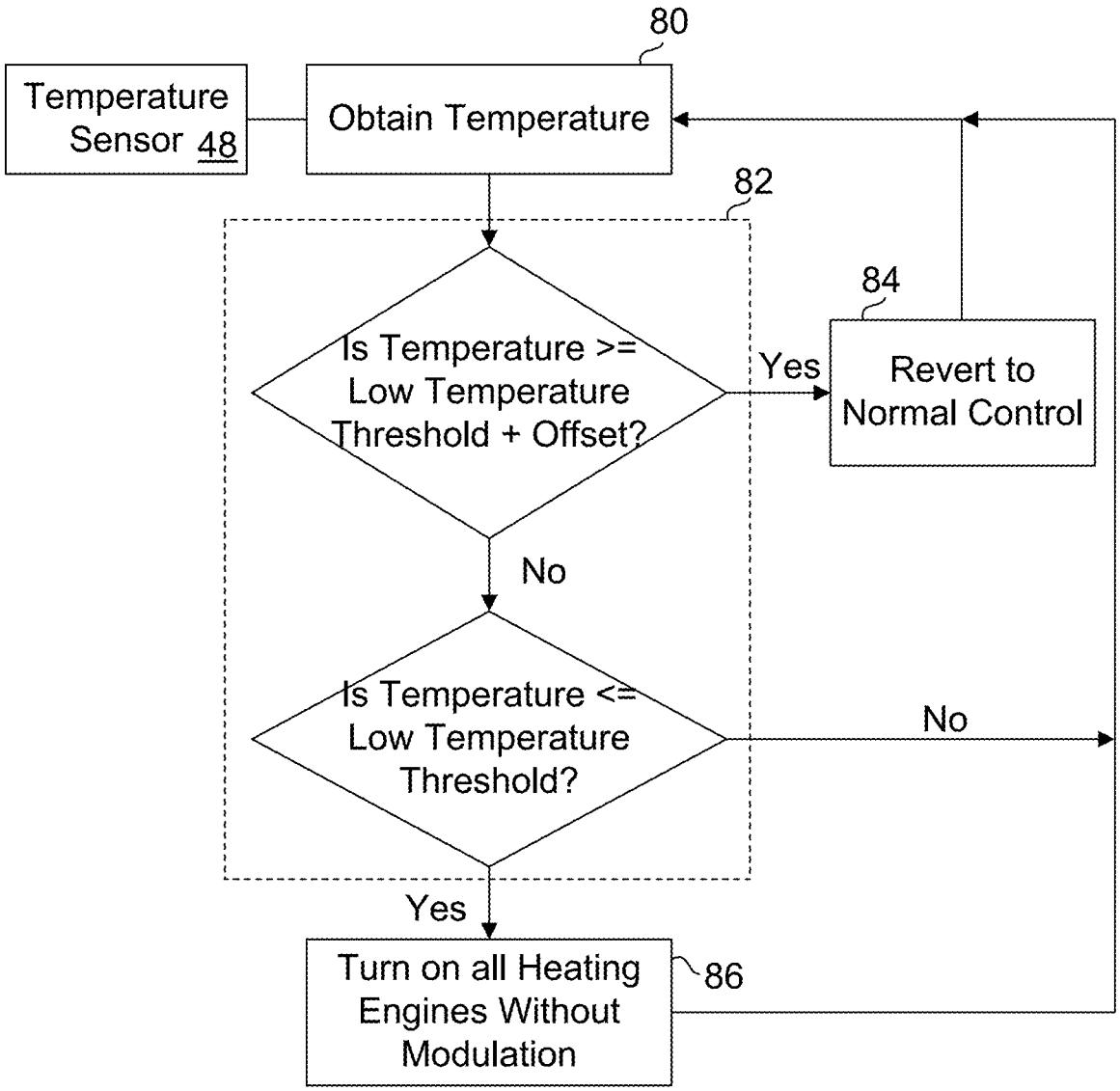
FIG. 9 is a flowchart of a freeze-risk monitoring and protective control routine executed by a controller.

FIG. 9 is a flowchart of a freeze-risk monitoring and protective control routine executed by a controller. The routine periodically acquires a housing-air temperature from a temperature sensor 48 as shown in step 80 and compares the reading to a configurable low-temperature threshold $T_l$ as shown in step 82. If the measured temperature T is less than or equal to $T_l$, the controller enters a freeze-protect state and turns on all heating units 70, e.g., heat exchangers/burners, and one or more circulation pumps with their associated internal and/or external recirculation loops, without modulation, as shown in step 86, to drive flow through water lines and raise internal temperature, e.g., residual water within the heating system. While in this state, the controller 50 continues sampling at a fixed cadence and holds the freeze-protect command until the temperature recovers to at least $T_l+\Delta T$, where $\Delta T$ is a hysteresis offset that prevents rapid toggling near the threshold.

If, upon sampling, $T \geq T_l+\Delta T$, the controller exits the freeze-protect state and reverts to normal control as shown in step 84, resuming ordinary modulation logic. When $T_l<T<T_l+\Delta T$, the routine neither initiates freeze-protect nor clears it. Instead, it loops to reacquire temperature, thereby maintaining state until a clear entry/exit condition is satisfied. In some embodiments the controller also (i) logs the event, and/or (ii) issues a local and/or remote alert, and/or (iii) enforces a hysteresis before reverting to normal control to avoid nuisance cycling. In one embodiment, the threshold $T_l$, offset $\Delta T$, e.g., a few degrees C., sampling period, and alert behavior may be user- or service-configurable. If more than one temperature sensor is used, readings from multiple temperature sensors may be averaged, the minimum or worst-case reading, or the maximum reading, may be used. In one embodiment, normal control includes variable-output control of a heating unit by varying at least one of firing rate, stage selection, duty cycle, fuel-valve position, blower speed, pump speed, and equivalent actuation to match thermal demand.

In some embodiments, the controller 50 is configured to compute a rate of change of the housing-air temperature T from successive samples of the temperature sensor 48, e.g., a sliding-window derivative dT/dt. When the magnitude of the temperature decrease exceeds a configurable threshold, e.g., a drop faster than about 1 degree C. per minute, the controller preemptively enters the freeze-protect state even if T has not yet fallen to $T_l$, thereby avoiding undershoot and incipient ice formation.

Figure 10:
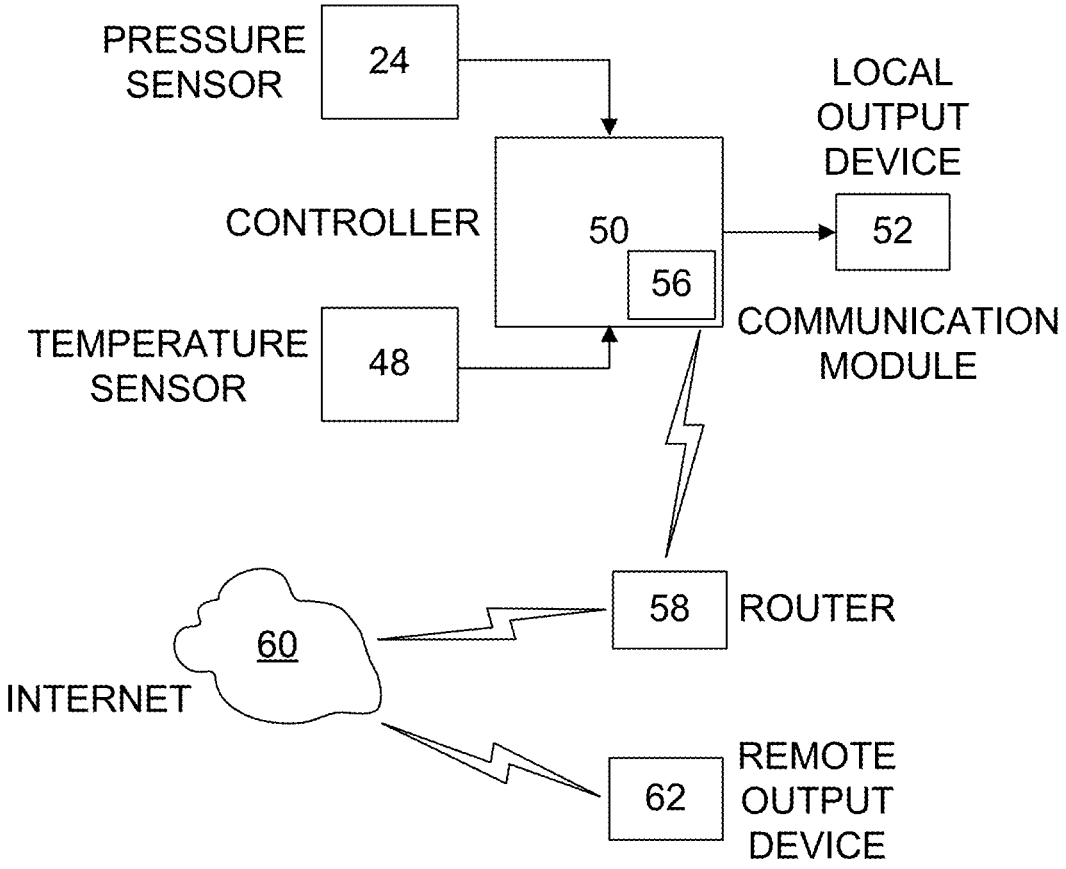
FIG. 10 is a block diagram of a control system configured to monitor a pressure sensor for a blocked condensate condition and a temperature sensor for a freezing condition.

FIG. 10 is a block diagram of a control and communications architecture for the condensate trap system and freeze-risk protection. A controller 50 receives inputs from a pressure sensor 24, e.g., via a pressure-sensing line, and from a temperature sensor 48 mounted within the appliance housing. Based on these signals, the controller determines a blocked-condensate condition and/or an approaching freeze condition, issues protective commands, e.g., activating heating units and circulation as described elsewhere, and generates alarms. Local annunciation is provided via a local output device 52, e.g., a human-machine interface (HMI), indicator, or sounder and in summary, local visual and/or audible alarm. Diagnostic fault codes may be logged in the controller 50 for further analysis. In a blocked-condensate condition, it is also possible to shut down at least one heating unit 70 to place the appliance in a safe state. The controller 50 further includes a communication module 56 enabling wired or wireless networking to a router or gateway 58, through a network or the internet 60, to a remote output device 62, e.g., service portal, mobile device, or building system. Remote messages may include alerts, status, and diagnostics. The depicted path is illustrative. Other communication topologies and protocols can be used.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A condensate trap system comprising:

a condensate trap comprising:

(a) a cap;

(b) a dip tube extending through the cap from a top end to a bottom end, the dip tube comprising a pressure sensing port biased upwardly, the pressure sensing port is configured to be disposed along the length of the dip tube proximate the top end of the cap and in fluid communication with an opening via an unvented pressure sensing line, the dip tube being configured to receive condensate from a condensate-generating appliance at the top end of the cap, the opening being in gas communication with a pressure sensor;

(c) a canister comprising a top end and a bottom end, a cup supported within the canister, and a drain port at the bottom end of the canister, the top end of the canister being removably coupled to the cap and the bottom end of the dip tube being disposed within an interior cavity of the cup; and (d) a controller, wherein the pressure sensor is operably connected to the controller and upon detecting the pressure indicative of blockage of condensate drainage through the trap, the controller is configured to provide a response selected from the group consisting of issuing a local visual and/or audible alarm via a local output device, transmitting a remote alert through a communication module to a remote output device, logging a diagnostic fault code in the controller, inhibiting modulation and shutting down at least one heating unit to place the appliance in a safe state, and any combinations thereof, wherein, in an unblocked condition in which neither the drain port nor a downstream portion thereof is obstructed, condensate received at the top end of the cap flows to fill and overflow the cup and exits the canister via the drain port; and wherein, in a blocked condition in which at least one of the drain port and a downstream portion thereof is obstructed, condensate fails to drain and rises to submerge the opening in the dip tube, thereby interrupting gas communication to the pressure sensor and causing the pressure sensor to register a pressure indicative of blockage of condensate drainage through the trap.

2. The condensate trap system of claim 1, wherein the top end of the canister is threadably coupled to the cap.

3. The condensate trap system of claim 1, wherein the top end of the dip tube is threadably coupled to a condensate drain tube.

4. The condensate trap system of claim 1, wherein the cup comprises a plurality of stands defining flow passages to the drain port when the cup overflows.

5. The condensate trap system of claim 1, wherein the cap further comprises a threaded male fitting configured to mate with a condensate drain tube.

6. The condensate trap system of claim 1, wherein the canister defines an internal volume of at least about 400 mL to provide debris-holding capacity before overflow to the drain port.

* * * * *